US005878872A

United States Patent [19]

Tsai

[11] Patent Number: 5,878,872

[45] Date of Patent: Mar. 9, 1999

[54] KEY SWITCH ASSEMBLY FOR A COMPUTER KEYBOARD

[76] Inventor: Huo-Lu Tsai, No. 126-1, Shui-Nan Rd., Pei-Tun Dist. Taichung City, Taiwan

[21] Appl. No.: 31,414

[22] Filed: Feb. 26, 1998

[51] Int. Cl.[6] ..... H01H 3/12; H01H 13/70

[52] U.S. Cl. ..... 200/344

[58] Field of Search ..... 200/5 A, 361, 200/342, 343, 344, 345, 512–517

[56] References Cited

U.S. PATENT DOCUMENTS

| | | | |
|---|---|---|---|
| 5,597,067 | 1/1997 | Yoneyama | 200/344 |
| 5,763,842 | 6/1998 | Tsai et al. | 200/344 X |
| 5,767,468 | 6/1998 | Tsai | 200/344 |
| 5,769,210 | 6/1998 | Tsai | 200/344 |
| 5,770,824 | 6/1998 | Tsai et al. | 200/344 X |

*Primary Examiner*—J. R. Scott
*Attorney, Agent, or Firm*—Merchant, Gould, Smith, Edell, Welter & Schmidt

[57] ABSTRACT

A key switch assembly includes a base board having a spaced pair of slide retainer plates which project upwardly from the base board and which define slide recesses with the base board, and a spaced pair of pivot retainer plates which project upwardly from the base board. A stop projection projects upwardly from the base board and is disposed between the pivot retainer plates. The stop projection is disposed posteriorly of the pivot retainer plates to define a clearance between the stop projection and rear sides of the pivot retainer plates. A membrane circuit layer is superimposed on the base board, and a resilient layer is superimposed on the membrane circuit layer and is provided with an upright resilient member. A scissors-type key cap support includes first and second support levers with upper and lower portions, and intermediate portions that are coupled rotatably about a pivot axis. The first support lever has a rearwardly projecting tab which abuts turnably against the stop projection on the base board. A key cap is biased upwardly by the upright resilient member, and is depressible to compress the resilient member.

4 Claims, 4 Drawing Sheets

KEY SWITCH ASSEMBLY FOR A COMPUTER KEYBOARD

BACKGROUND OF THE INVENTION

1. Field of the Invention

The present invention relates to a key switch assembly for a computer keyboard, more particularly to a key switch assembly which has a relatively simple and stable structure with a reduced thickness.

2. Description of the Related Art

FIG. 1 illustrates a conventional key switch assembly which includes a base board 1, a membrane circuit plate 2 disposed on the base board 1, a resilient layer 3 provided on the membrane circuit plate 2, a bridge-device support plate 4 disposed on the resilient layer 3, a key cap 6, a bridge device 5 provided between the support plate 4 and the key cap 6, and a resilient biasing member 3*a* extending from the resilient layer 3 and through the support plate 4 and the bridge device 5 to bias the key cap 6 upwardly. The support plate 4 has pivot retainer plates 4*b* for retaining pivotally the lower end of a front section of the bridge device 5, and slide retainer plates 4*a* for retaining slidably the lower end of a rear section of the bridge device 5. The key cap 6 has a bottom side provided with a pivot retainer unit 6*b* for retaining pivotally the upper end of the front section of the bridge device 5, and a slide retainer unit 6*a* for retaining slidably the upper end of the rear section of the bridge device 5.

The above-described key switch assembly can be operated by depressing the key cap 6 to cause the membrane circuit plate 2 to create an electrical signal, and by releasing the key cap 6 to allow the key cap 6 to be biased upwardly by the biasing member 3*a*. In recent years, computer keyboards tend to be made thinner to reduce the size of computers, especially in portable computer applications. It is noted that the aforementioned key switch assembly has a relatively large thickness which cannot be significantly reduced since the bridge device 5 is provided between the key cap 6 and the support plate 4. The key switch assembly of FIG. 1 is thus not suitable for use in a portable computer.

FIG. 2 illustrates another conventional key switch assembly which also includes a base board 7, a membrane circuit plate 7*c*, a resilient layer 7*d*, a scissors-type bridge device 8, a key cap 9, and an upright biasing member 9*c* provided on the resilient layer 7*d*. The base board 7 has two pairs of pivot lobes 7*a*, 7*b* which extend upwardly through the membrane circuit plate 7*c* and the resilient layer 7*d*. The pivot lobes 7*a* have inclined, elongated pivot holes 7*a*' formed therein. The scissors-type bridge device 8 has lower ends mounted pivotally to the pivot lobes 7*a*, 7*b*, and upper ends mounted pivotally to elongated slots 9*a* and pivot grooves 9*b* formed on a bottom side of the key cap 9.

Although the key switch assembly of FIG. 2 has a reduced thickness as compared to the conventional key switch assembly of FIG. 1 in view of the mounting of the bridge device 8 between the base board 7 and the key cap 9, the key switch assembly of FIG. 2 still suffers from the following disadvantages:

1) The inclined, elongated pivot holes 7*a*' can result in deformation and unstable movement of the bridge device 8 when the key cap 9 is depressed.

2) During assembly, pin protrusions provided on the lower ends of the bridge device 8 must be forced inwardly at first so that they can be mounted within the pivot lobes 7*a*, 7*b*. The key switch assembly is thus difficult to assemble and might be damaged during assembly of the same.

3) Since no engagement means is provided between the key cap 9 and the biasing member 9*c*, improper operation of the key switch assembly can result when the key cap 9 is depressed.

In addition, in a typical notebook computer, electrical connectors of the membrane circuit plate must be bent and disposed between the membrane circuit plate and the base board due to insufficient space within the notebook computer. As such, an opening might be formed between the base board and the membrane circuit plate. Dust can easily enter into the opening between the base board and the membrane circuit plate during assembly and transport of the notebook computer, thereby affecting the conductivity of the membrane circuit plate.

SUMMARY OF THE INVENTION

The main object of the present invention is to provide a key switch assembly which has a relatively simple and stable structure with a reduced thickness.

Accordingly, the key switch assembly of the present invention includes a base board, a membrane circuit layer, a resilient layer, a scissors-type key cap support and a key cap. The base board has a front part formed with a first slide retainer unit, and a rear part formed with a first pivot retainer unit. The first slide retainer unit includes a spaced pair of slide retainer plates which project upwardly from the base board. Each of the slide retainer plates has a vertical portion and a wider lateral horizontal portion on a top end of the vertical portion, and defines a slide recess with the base board. The first pivot retainer unit includes a spaced pair of pivot retainer plates which project upwardly from the base board. Each of the pivot retainer plates includes an upright portion and a rearwardly projecting portion on a top end of the upright portion. The first pivot retainer unit further includes a stop projection which projects upwardly from the base board and which is disposed between the pivot retainer plates. The stop projection is disposed posteriorly of the pivot retainer plates to define a clearance between the stop projection and rear sides of the upright portions of the pivot retainer plates. The rearwardly projecting portion of each of the pivot retainer plates forms a restricted entrance to the clearance. The membrane circuit layer is superimposed on the base board and is formed with a pair of first openings for extension of the slide retainer plates therethrough, and a set of second openings for extension of the pivot retainer plates and the stop projection therethrough. The membrane circuit layer has an electrical contact. The resilient layer is superimposed on the membrane circuit layer and is provided with an upright resilient member. The resilient layer is formed with a pair of third openings aligned respectively with the first openings to permit extension of the slide retainer plates therethrough, and a set of fourth openings aligned respectively with the second openings for extension of the pivot retainer plates and the stop projection therethrough. The scissors-type key cap support includes first and second support levers with upper and lower portions, and intermediate portions that are coupled rotatably about a pivot axis. The first support lever has a U-shaped frame section with two parallel arms and a transverse connecting portion that interconnects the parallel arms. The lower portion of the first support lever is formed with an opposite pair of pivot shafts which project outwardly from the parallel arms and which are forced into the clearance via the restricted entrances for pivotal retention on the base board by the pivot retainer plates. The transverse connecting portion is formed with a rearwardly projecting tab which abuts turnably against the stop projection on the base board. The second support lever has a U-shaped frame with parallel rods. The lower portion of the second support lever is formed with an opposite pair of outward slide shafts which project outwardly from the parallel rods and which extend respectively into the slide recesses for slidable retention on the base board. The key cap has a bottom side formed with a second slide retainer unit for retaining slidably the upper portion of the first support lever, and a second pivot retainer unit for retaining pivotally the upper portion of the second support lever. The key cap is biased upwardly by the upright resilient member, and is depressible to compress the resilient member and permit the resilient member to contact the electrical contact and enable the membrane circuit layer to produce an electrical signal.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 3:
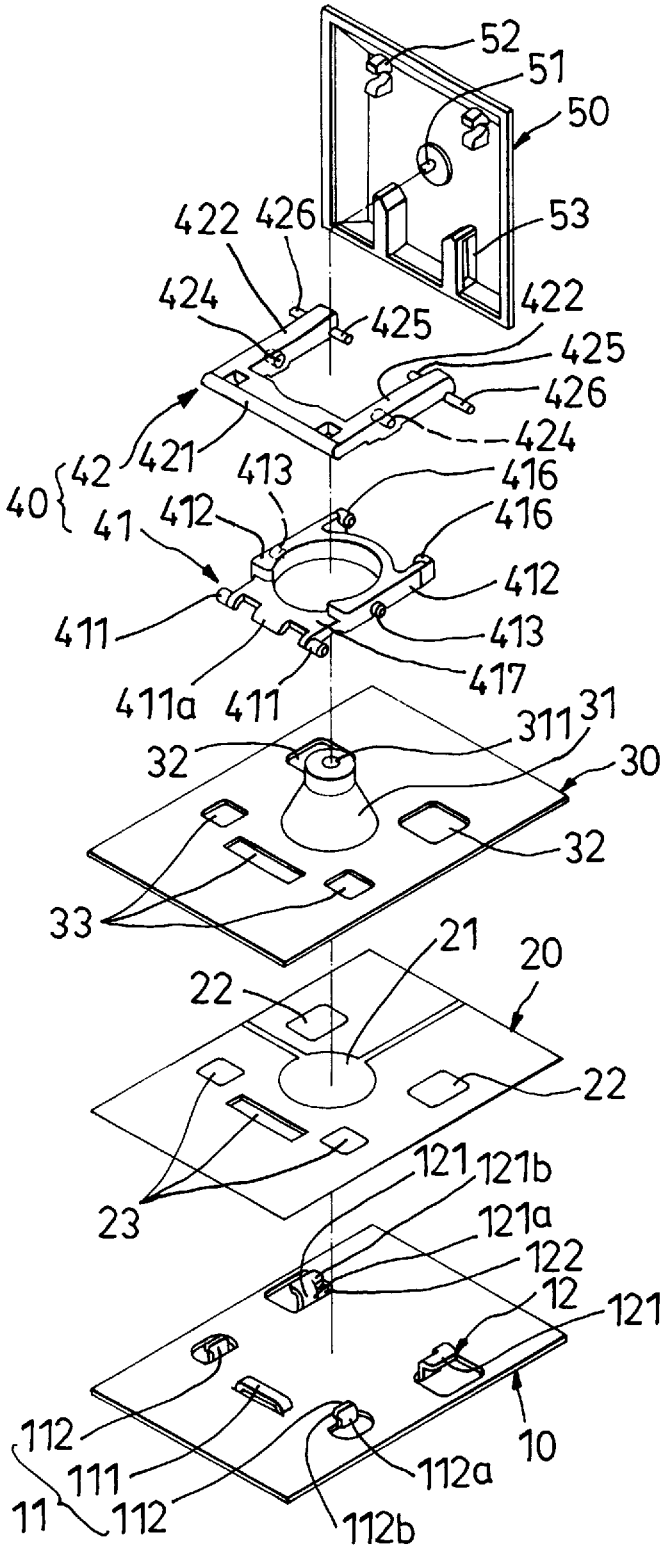
FIG. 3 is an exploded perspective view of a preferred embodiment of the key switch assembly of the present invention.

Referring to FIG. 3, the preferred embodiment of a key switch assembly according to the present invention is shown to include a base board 10, a membrane circuit layer 20, a resilient layer 30, a scissors-type key cap support 40 and a key cap 50.

Figure 6:
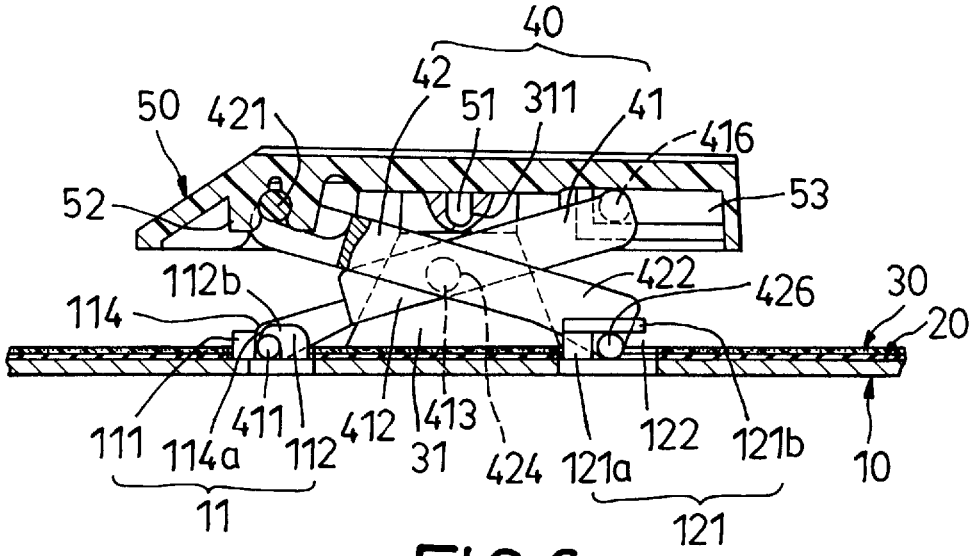
FIG. 6 is a vertical sectional view of the preferred embodiment, where the key cap thereof is shown to be in a non-depressed position.

The base board 10 has a front part formed with a first slide retainer unit 12, and a rear part formed with a first pivot retainer unit 11. The first slide retainer unit 12 includes a spaced pair of slide retainer plates 121 which are formed by punching and which project upwardly from the base board 10. Each of the slide retainer plates 121 is generally L-shaped, and includes a vertical portion 121*a* and a wider horizontal portion 121*b* on a top end of the vertical portion 121*a* to define a slide recess 122 with the base board 10. The first pivot retainer unit 11 is similarly formed by punching, and includes a spaced pair of pivot retainer plates 112 which project upwardly from the base board 10, and a stop projection 111 which projects upwardly from the base board 10 and which is disposed between the pivot retainer plates 112. Each of the pivot retainer plates 112 includes an upright portion 112*a* and a rearwardly projecting portion 112*b* on a top end of the upright portion 112*a*. As shown in FIG. 6, the stop projection 111 is disposed posteriorly of rear sides of the pivot retainer plates 112 to define a clearance 114 between the stop projection 111 and the pivot retainer plates 112. The rearwardly projecting portion 112*b* of each of the pivot retainer plates 112 forms a restricted entrance 114*a* to the clearance 114.

Referring again to FIG. 3, the membrane circuit layer 20 is superimposed on the base board 10 and has an electrical contact 21. The membrane circuit layer 20 is formed with a pair of first openings 22 for extension of the slide retainer plates 121 therethrough, and a set of second openings 23 for extension of the pivot retainer plates 112 and the stop projection 111 therethrough.

The resilient layer 30 is superimposed on the membrane circuit layer 20 and is provided with an upright resilient member 31 that is aligned with the electrical contact 21 of the membrane circuit layer 20. The resilient member 31 has a top side formed with a positioning hole 311. The resilient layer 30 is formed with a pair of third openings 32 aligned respectively with the first openings 22 to permit extension of the slide retainer plates 121 therethrough, and a set of fourth openings 33 aligned respectively with the second openings 23 for extension of the pivot retainer plates 112 and the stop projection 111 therethrough. Each of the third openings 32 is larger than a respective one of the first openings 22 SO that a periphery of each of the second openings 22 is exposed via the respective third opening 32.

The scissors-type key cap support 40 includes a first support lever 41 and a second support lever 42. The first support lever 41 has a U-shaped frame section with two parallel arms 412 and a transverse connecting portion 417 interconnecting the parallel arms 412. The first support lever 41 has a lower portion formed with an opposite pair of pivot shafts 411 which project outwardly from lower ends of the parallel arms 412 and which can be forced into the clearance 114 (see FIG. 6) via the restricted entrances 114*a* for pivotal retention on the base board 10 by the pivot retainer plates 112. The first support lever 41 has an upper portion formed with an opposite pair of slide shafts 416 which project inwardly from upper ends of the parallel arms 412. The first support lever 41 further has an intermediate portion between the upper and lower portions and formed with an aligned pair of tapered pins 413 that project from outer edges of the parallel arms 412. The transverse connecting portion 417 is formed with a rearwardly projecting tab 411*a* between the pivot shafts 411. The tab 411*a* abuts turnably against a front side of the stop projection 111.

Figure 5:
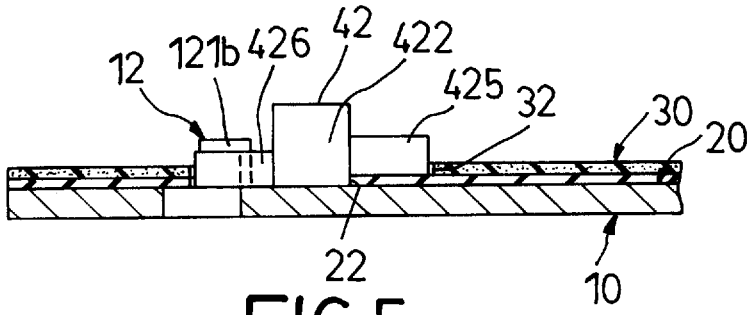
FIG. 5 is a partly sectional view of the preferred embodiment, taken along line V—V in FIG. 4.

The second support lever 42 has a U-shaped frame with parallel rods 422 that have inner edges flanking the outer edges of the parallel arms 412 of the first support lever 41. The second support lever 42 has a lower portion formed with an opposite pair of outward slide shafts 426 and an opposite pair of inward slide shafts 425. The outward slide shafts 426 project outwardly from lower ends of the parallel rods 422 and extend respectively into the slide recesses 122 for slidable retention on the base board 10 by the slide retainer plates 121. The wider lateral portions 121*b* of the slide retainer plates 121 prevent disengagement of the outward slide shafts 426 from the slide recesses 122. The inward slide shafts 425 project inwardly from the lower ends of the parallel rods 422. As shown in FIG. 5, the inward slide shafts 425 are disposed within the third openings 32 and press against the membrane circuit layer 20 at the periphery of a corresponding one of the second openings 22 to result in close contact between the membrane circuit layer 20 and the base board 10. The second support lever 42 further has an upper portion formed with a transverse pivot rod 421 that interconnects the parallel rods 422, and an intermediate portion formed with an aligned pair of pin bores 424 on the inner edges of the parallel rods 422. Each of the tapered pins 413 extends fittingly and rotatably into an adjacent one of the pin bores 424 for coupling pivotally the intermediate portions of the first and second support levers 41, 42 thereabout.

The key cap 50 has a bottom side formed with a second slide retainer unit 53 for retaining slidably the slide shafts 416 of the upper portion of the first support lever 41, and a second pivot retainer unit 52 for retaining pivotally the pivot rod 421 of the upper portion of the second support lever 42. The key cap 50 is biased upwardly by the resilient member 31 and is depressible to compress the resilient member 31 and permit the resilient member 31 to contact the electrical contact 21 and enable the membrane circuit layer 20 to produce an electrical signal. The bottom side of the key cap 50 is further formed with a positioning protrusion 51 that engages the positioning hole 311 of the resilient member 31.

Figure 4:
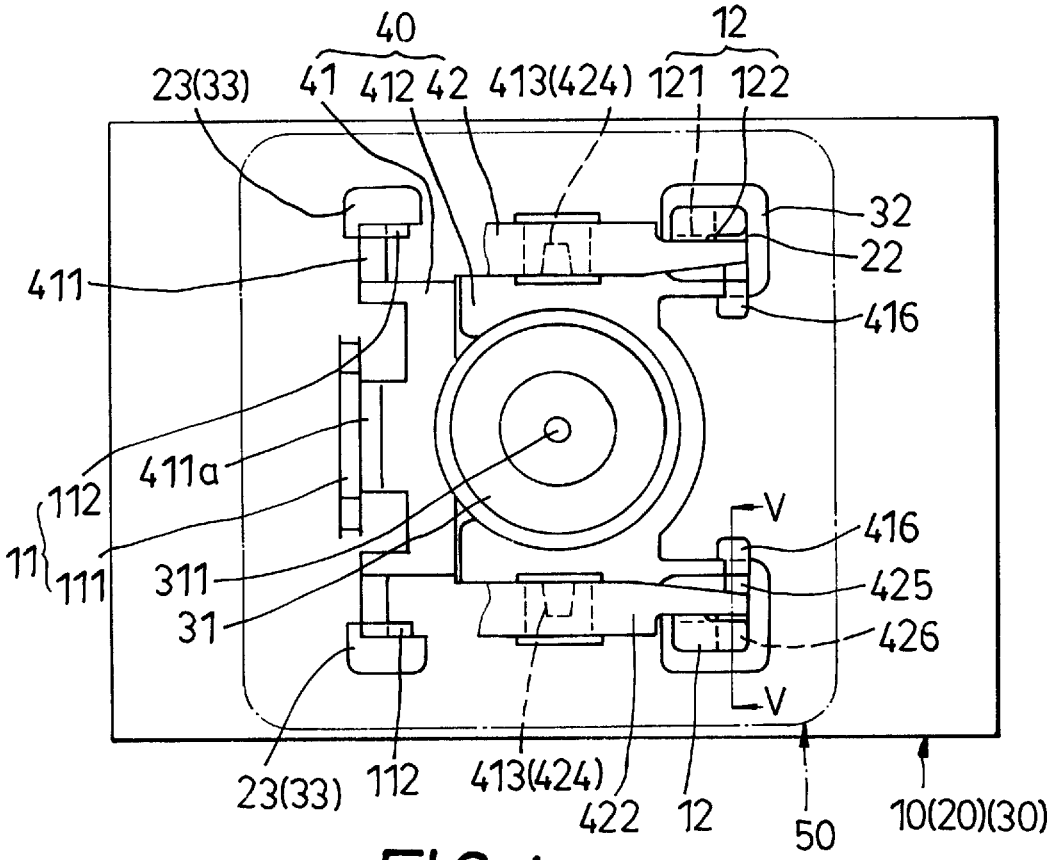
FIG. 4 is a top view of the preferred embodiment of the present invention, a key cap thereof being shown in dotted lines for the sake of clarity.

Referring to FIGS. 4 to 6, after assembly, the membrane circuit layer 20 is superimposed on the base board 10, and the resilient layer 30 is superimposed on the membrane circuit layer 20. The slide retainer plates 121, the pivot retainer plates 112 and the stop projections 111 extend above the resilient layer 30 via the openings 22, 32, 23, 33 so that the pivot shafts 411 are retained pivotally in the clearance 114 between the stop projection 111 and the rear sides of the pivot retainer plates 112, and so that the outward slide shafts 426 are retained in the slide recesses 122 by the slide retainer plates 121. The inward slide shafts 425 press against the membrane circuit layer 20 to result in close contact between the membrane circuit layer 20 and the base board 10 to prevent entry of dust from between the membrane circuit layer 20 and the base board 10 to prevent any adverse affect to the conductivity of the membrane circuit layer 20. The slide shafts 416 of the first support lever 41 are retained slidably on the second slide retainer unit 53 of the key cap 50. The pivot rod 421 of the upper portion of the second support lever 42 is retained rotatably in the second pivot retainer unit 52. The upright resilient member 31 biases the key cap 50 upwardly to maintain the key cap 50 at a predetermined height.

Figure 7:
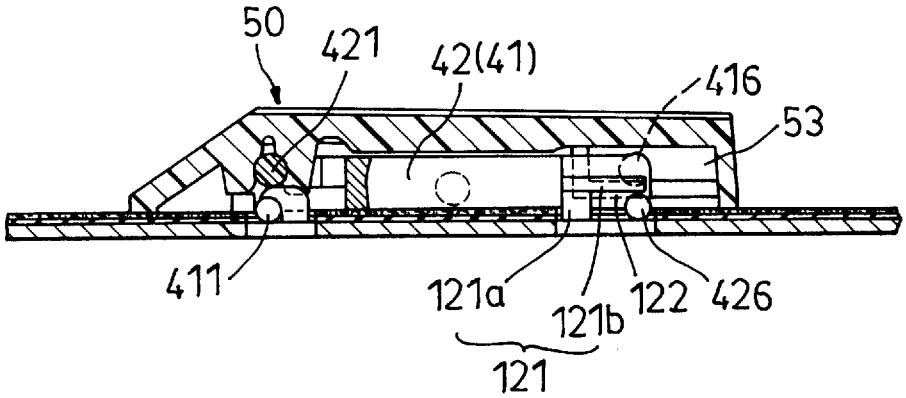
FIG. 7 is another vertical sectional view of the preferred embodiment, where the key cap thereof is shown to be in a fully depressed position.

Referring to FIG. 7, when the key cap 50 is depressed, the pivot shafts 411 and the pivot rod 421 rotate, and the slide shafts 416 and the outward slide shafts 426 slide respectively along the second slide retainer unit 53 and the slide recesses 122. At this time, the resilient member 31 (see FIG. 6) is compressed. When the depressing force is released, the resilient member 31 biases the key cap 50 upwardly to return the key cap 50 to the non-depressed position, as shown in FIG. 6.

Figure 1:
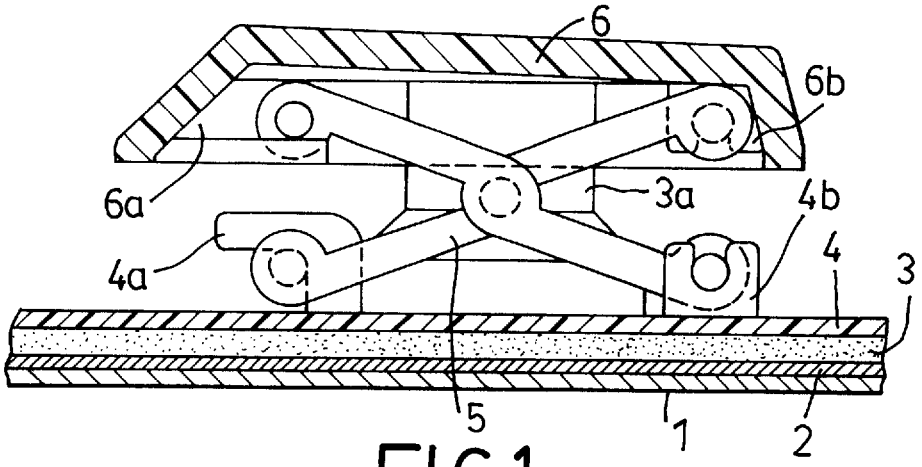
FIG.1 PRIOR ART
FIG. 1 is a vertical sectional view of a conventional key switch assembly.
Figure 2:
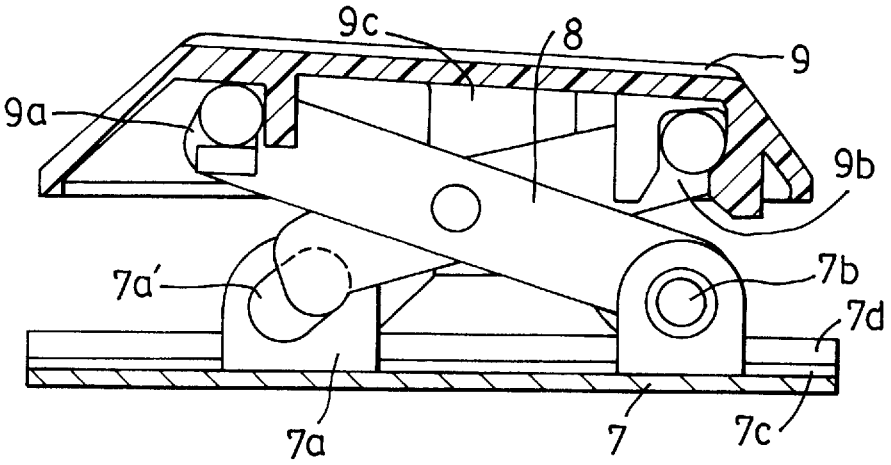
FIG.2 PRIOR ART
FIG. 2 is a vertical sectional view of another conventional key switch assembly.

Accordingly, the thickness of the key switch assembly of the present invention can be significantly reduced as compared to the conventional key switch assembly of FIG. 1 since the scissors-type key cap support 40 is mounted between the base board 10 and the key cap 50. In addition, unlike the conventional key switch assembly of FIG. 2, the slide shafts 416, 426 slide smoothly in the second slide retainer unit 53 and the slide recesses 122 during operation of the key cap 50. With the provision of the positioning hole 311 and the positioning protrusion 51, the key cap 50 is positioned on the top side of the resilient member 31 so that the key cap 50 can be operated more precisely.

It is noted that since the inward slide shafts 425 of the second support lever 42 press against the membrane circuit layer 20, an opening will not be formed between the base board 10 and the membrane circuit layer 20 to prevent entry of dust between the base board 10 and the membrane circuit layer 20 even though the electrical connector disposed between the membrane circuit layer 20 and the base board 10 is bent.

With this invention thus explained, it is apparent that numerous modifications and variations can be made without departing from the scope and spirit of this invention. It is therefore intended that this invention be limited only as indicated in the appended claims.

I claim:

1. A key switch assembly for a computer keyboard, said key switch assembly comprising:

a base board having a front part formed with a first slide retainer unit and a rear part formed with a first pivot retainer unit, said first slide retainer unit including a spaced pair of slide retainer plates which project upwardly from said base board, each of said slide retainer plates having a vertical portion and a wider lateral horizontal portion on a top end of said vertical portion and defining a slide recess with said base board, said first pivot retainer unit including a spaced pair of pivot retainer plates which project upwardly from said base board, each of said pivot retainer plates including an upright portion and a rearwardly projecting portion on a top end of said upright portion, said first pivot retainer unit further including a stop projection which projects upwardly from said base board and which is disposed between said pivot retainer plates, said stop projection being disposed posteriorly of said pivot retainer plates to define a clearance between said stop projection and rear sides of said upright portions of said pivot retainer plates, said rearwardly projecting portion of each of said pivot retainer plates forming a restricted entrance to said clearance;

a membrane circuit layer superimposed on said base board and formed with a pair of first openings for extension of said slide retainer plates therethrough, and a set of second openings for extension of said pivot retainer plates and said stop projection therethrough, said membrane circuit layer having an electrical contact;

a resilient layer superimposed on said membrane circuit layer and provided with an upright resilient member, said resilient layer being formed with a pair of third openings aligned respectively with said first openings to permit extension of said slide retainer plates therethrough, and a set of fourth openings aligned respectively with said second openings for extension of said pivot retainer plates and said stop projection therethrough;

a scissors-type key cap support including first and second support levers with upper and lower portions, and intermediate portions that are coupled rotatably about a pivot axis, said first support lever having a U-shaped frame section with two parallel arms and a transverse connecting portion interconnecting said parallel arms, said lower portion of said first support lever being formed with an opposite pair of pivot shafts which project outwardly from said parallel arms and which are forced into said clearance via said restricted entrances for pivotal retention on said base board by said pivot retainer plates, said transverse connecting portion being formed with a rearwardly projecting tab which abuts turnably against said stop projection on said base board, said second support lever having a U-shaped frame with parallel rods, said lower portion of said second support lever being formed with an opposite pair of outward slide shafts which project outwardly from said parallel rods and which extend respectively into said slide recesses for slidable retention on said base board; and a key cap having a bottom side formed with a second slide retainer unit for retaining slidably said upper portion of said first support lever, and a second pivot retainer unit for retaining pivotally said upper portion of said second support lever, said key cap being biased upwardly by said upright resilient member and being depressible to compress said resilient member and permit said resilient member to contact said electrical contact and enable said membrane circuit layer to produce an electrical signal.

2. The key switch assembly according to claim 1, wherein each of said third openings is larger than the respective one of said first openings, said lower portion of said second support lever being further formed with an opposite pair of inward slide shafts which project inwardly from said parallel rods, said inward slide shafts extending above said membrane circuit layer and being disposed within said third openings of said resilient layer, said inward slide shafts pressing against said membrane circuit layer to result in close contact between said membrane circuit layer and said base board.

3. The key switch assembly as claimed in claim 1, wherein said parallel arms of said first support lever have outer edges, said parallel rods of said second support lever having inner edges that flank said outer edges of said first support lever, said intermediate portion of said first support lever being formed with an aligned pair of tapered pins on said outer edges, said tapered pins tapering outwardly, said intermediate portion of said second support lever being formed with an aligned pair of pin bores on said inner edges, each of said tapered pins extending fittingly and rotatably into a respective one of said pin bores for coupling pivotally said intermediate portions of said first and second support levers.

4. The key switch assembly as claimed in claim 1, wherein said resilient member has a top side formed with a positioning hole, said bottom side of said key cap being formed with a positioning protrusion that engages said positioning hole.

* * * * *